US008056229B2

(12) United States Patent
Wilson et al.

(10) Patent No.: US 8,056,229 B2
(45) Date of Patent: Nov. 15, 2011

(54) METHOD OF MANUFACTURING A TUBULAR SUPPORT STRUCTURE

(75) Inventors: Rickey A. Wilson, Chippewa Township, Wayne County, OH (US); Ross G. Robinson, Brantford, OH (US); David K. Meisenhelter, Massillon, OH (US); James L. Barkan, Massillon, OH (US); Harry E. Hillegass, Canal Fulton, OH (US)

(73) Assignees: Babcock & Wilcox Power Generation Group, Inc., Barberton, OH (US); Babcock & Wilcox Canada Ltd., Cambridge, Ontario (CA)

( * ) Notice: Subject to any disclaimer, the term of this patent is extended or adjusted under 35 U.S.C. 154(b) by 1129 days.

(21) Appl. No.: 11/749,967

(22) Filed: May 17, 2007

(65) Prior Publication Data

US 2008/0128580 A1 Jun. 5, 2008

(51) Int. Cl.
*B21D 53/02* (2006.01)

(52) U.S. Cl. ..... 29/890.03; 29/890.043; 29/726.5; 165/162; 165/177; 165/178

(58) Field of Classification Search ..... 29/890.03, 29/890.037, 890.052, 890.053, 726.5, 890.038, 29/890.04, 890.043; 165/76, 78, 162, 163, 165/177, 178; 122/510; 228/48, 49.1, 49.3, 228/126, 131, 143, 145; 148/519
See application file for complete search history.

(56) References Cited

U.S. PATENT DOCUMENTS

| | | | | | |
|---|---|---|---|---|---|
| 1,672,650 | A | * | 6/1928 | Lonsdale | 165/160 |
| 2,085,632 | A | * | 6/1937 | Burkhart | 165/76 |
| 2,487,626 | A | * | 11/1949 | Wittman | 165/82 |
| 2,729,433 | A | * | 1/1956 | Berg | 165/103 |
| 2,743,089 | A | * | 4/1956 | Gardner et al. | 165/109.1 |
| 2,961,221 | A | * | 11/1960 | Friese et al. | 165/83 |
| 3,406,752 | A | * | 10/1968 | Lion | 165/173 |
| 4,105,065 | A | * | 8/1978 | Chirico | 165/78 |
| 4,253,516 | A | * | 3/1981 | Giardina | 165/78 |
| 4,299,273 | A | * | 11/1981 | Fischli | 165/78 |
| 4,513,694 | A | * | 4/1985 | Wiemer | 122/7 R |
| 4,592,416 | A | * | 6/1986 | Mattison et al. | 165/83 |
| 4,633,940 | A | * | 1/1987 | Gentry et al. | 165/159 |
| 4,871,014 | A | * | 10/1989 | Sulzberger | 165/76 |
| 5,181,560 | A | * | 1/1993 | Burn | 165/162 |
| 6,089,312 | A | * | 7/2000 | Biar et al. | 165/118 |

* cited by examiner

*Primary Examiner* — David Bryant
*Assistant Examiner* — Ryan J Walters
(74) *Attorney, Agent, or Firm* — Eric Marich

(57) ABSTRACT

A method and apparatus particularly suited to the manufacture and assembly of cage-like, substantially cylindrical structures made of long, slender tubular components which, by themselves, are not self-supporting, employs an exo-skeleton structure to assemble cage-like, tubular structures in pie-shaped, longitudinal segments while in a horizontal or vertical position utilizing longitudinal or circumferential attachments. The apparatus comprises at least two segments which permit construction of subassemblies of the cage-like, tubular structure and their transportation, if necessary, to a remote site where they may be finally assembled.

6 Claims, 17 Drawing Sheets

METHOD OF MANUFACTURING A TUBULAR SUPPORT STRUCTURE

FIELD AND BACKGROUND OF THE INVENTION

The present invention relates generally to the manufacture of heat transfer apparatus and, in particular, to methods and apparatus for assembling vessels or vessel internals such as substantially cylindrical, cage-like structures made of tubular components, in pie-shaped, longitudinal segments while in a horizontal or vertical position utilizing longitudinal or circumferential attachments.

Certain types of heat transfer apparatus comprise tubular, fluid conveying structures arranged in specified geometries. During operation, these tubular structures convey a cooling fluid, such as water, steam or mixtures thereof through an interior portion of the tubes, while hot gases are conveyed around outside surfaces of the tubes. Heat from the hot gases is conveyed through the tube walls into the cooling fluid which is conveyed to other locations or devices, such as turbines or other devices, for use. The properties of the hot gases, which include but are not limited to their temperature, chemical constituents, corrosion potential, emissivity, and their slagging and/or fouling potential, influence the geometries, spacing, arrangement, materials, and sizing of the tubular structures to a great degree.

The construction of radiant synthesis gas (syngas) cooler apparatus used to contain and cool the synthesis gas produced by a coal gasification process such as an Integrated Gasification Combined Cycle (IGCC) power plant is a classic example of one type of heat transfer apparatus where the properties of the hot gases influence the tubular, fluid conveying structures provided within the syngas cooler. These syngas coolers are typically long, substantially cylindrical pressure vessels which contain within an external shell of the vessel a specific arrangement of tubular, fluid conveying structures which are used to extract heat from the hot synthesis gas and when erected may be on the order of 100 feet tall or more, and have a diameter on the order of 20 feet or more.

The tubular, fluid conveying structures within such syngas coolers typically comprise a substantially cylindrical, cage-like structure within which may be located additional tubular structures known as division or platen walls. The cage-like structure may be substantially cylindrical along a central portion thereof, and provided with inlet and outlet structures which may be frustoconical or tapered to admit and exhaust, respectively, the hot synthesis gases into the cage-like structure during operation. Headers and/or manifolds are generally provided at both the inlet and outlet structures to provide common locations for the delivery and removal of the fluid conveyed through the cage-like structure.

While the headers and manifolds may have substantial diameters and wall thicknesses, the majority of the cage-like, tubular structure is comprised of long, slender tubes on the order of 2" outside diameter (O.D.). These tubes are generally straight, and only bent as necessary to accommodate the aforementioned inlet and outlet structures. The substantially cylindrical walls of the cage-like structure are formed of these tubes and welded to one another by means of a membrane structure as is known to those skilled in the boiler arts. Furthermore, while the division or platen walls which may be provided in an interior portion are generally planar structures comprised of membraned tubes, they may have other shapes, such as an angled or "dog leg" configuration, and they may not be attached to the substantially cylindrical walls or to the inlet and outlet structures and thus the entire cage-like, tubular structure is not a rigid, easily handled structure nor can it be easily manipulated.

It is thus clear that development of an efficient technique for manufacturing and transporting heat transfer devices comprising substantially cylindrical, cage-like structures made of long, slender tubular components would be welcomed by industry.

SUMMARY OF THE INVENTION

One aspect of the present invention is drawn to an apparatus, referred to as a Polygon Tumble Assembler, which employs an exo-skeleton structure to assemble vessels and/or vessel internals in pie-shaped, longitudinal segments while in a horizontal or vertical position utilizing longitudinal or circumferential attachments. The vessel internals may comprise a substantially cylindrical, cage-like structure made of tubular components. The apparatus comprises at least two segments which permit construction of subassemblies of the cage-like structure made of tubular components and their transportation, if necessary, to a remote site where they may be finally assembled. As used herein, pie-shaped embraces any generally triangular- or wedge-shapes, where all sides are substantially straight or where one side may be in the form of an arc or curved, as well as wedge-shapes formed by taking a triangular shape and removing a portion of the narrow end to produce a four-sided shape.

Another aspect of the present invention is drawn to a method of manufacturing vessels and or vessel internals in pie-shaped, longitudinal segments while in a horizontal or vertical position utilizing longitudinal or circumferential attachments. The vessel internals may comprise a substantially cylindrical, cage-like structure made of tubular components. The method employs an exo-skeleton structure to permit construction of subassemblies of the cage-like structure made of tubular components and their transportation, if necessary, to a remote site where the vessels may be finally assembled.

The exo-skeleton apparatus of the present invention allows for the assembly of a 360 (or more or less) degree cage-like, tubular structure or vessel in pie-shaped, longitudinal segments, in addition to conventional circular segments. It reduces the needed weight capacity requirements of cranes, allowing for the assembly of complex heavy vessels in the shop or in the field. It provides fixturing for accurate placement of vessel internals during assembly. It functions as a shipping rig or transport device for the unit being built. Depending upon the final method of assembly, it may function as an up-ending device for vessel internals or as a conveying structure to permit the cage-like, tubular structure to be slid into an external vessel shell. The exo-skeleton apparatus used in the methods of the present invention are reusable. It allows for an assembly line approach for the construction of many subassemblies and final assemblies to occur simultaneously.

The present invention is particularly suited to the manufacture and assembly of cage-like, substantially cylindrical structures made of long, slender tubular components which, by themselves, are not self-supporting.

The present invention may be used in the construction of radiant synthesis gas (syngas) cooler apparatus used to contain and cool the synthesis gas produced by a coal gasification process such as an Integrated Gasification Combined Cycle (IGCC) power plant.

The various features of novelty which characterize the invention are pointed out with particularity in the claims annexed to and forming a part of this disclosure. For a better understanding of the invention, its operating advantages and the specific benefits attained by its uses, reference is made to the accompanying drawings and descriptive matter in which preferred embodiments of the invention are illustrated.

DESCRIPTION OF THE PREFERRED EMBODIMENTS

Figure 1:
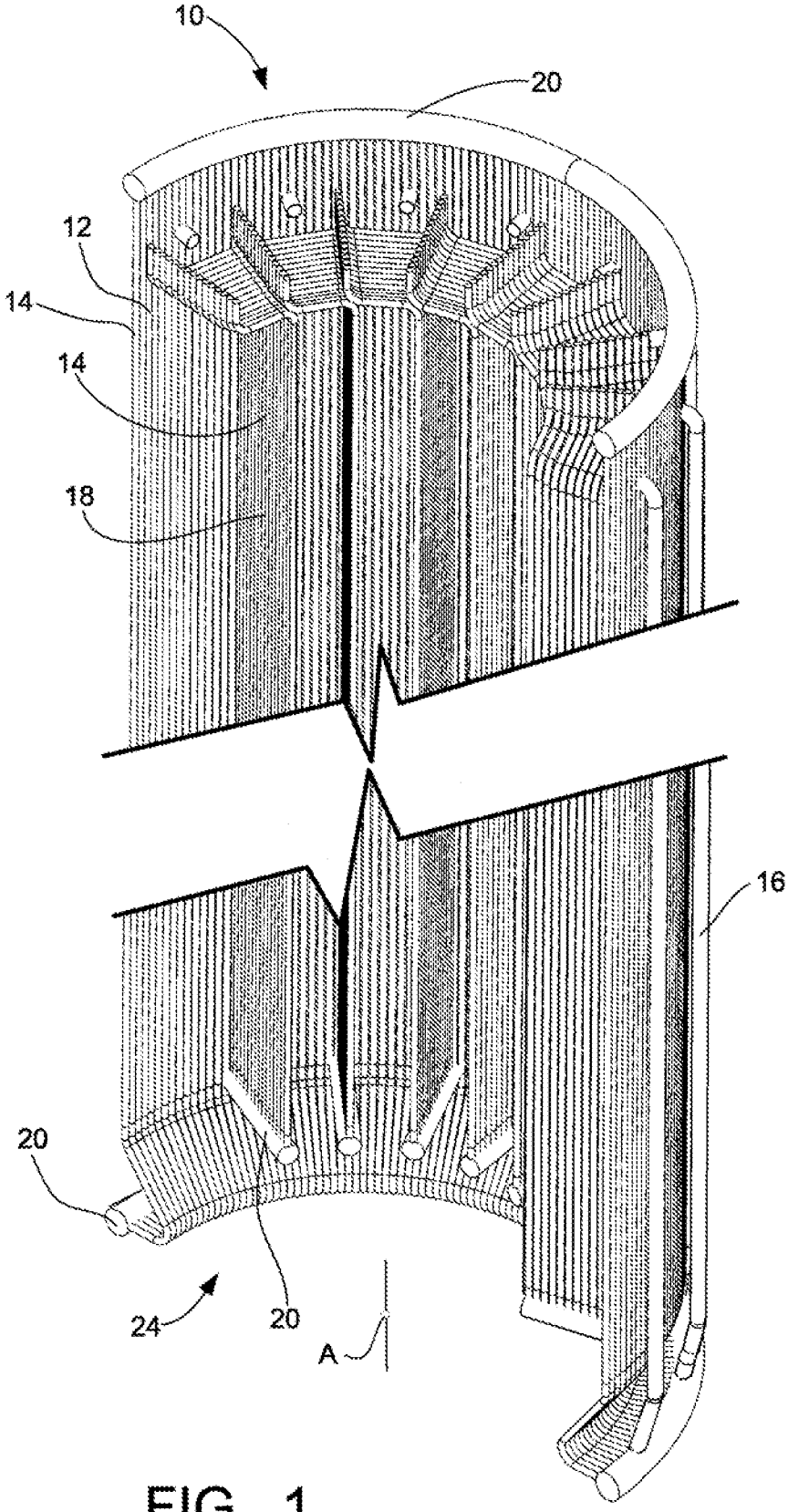
FIG. 1 is a perspective view, partly in section, of a cage-like tubular structure to which the principles of the present invention may be applied.
Figure 2:
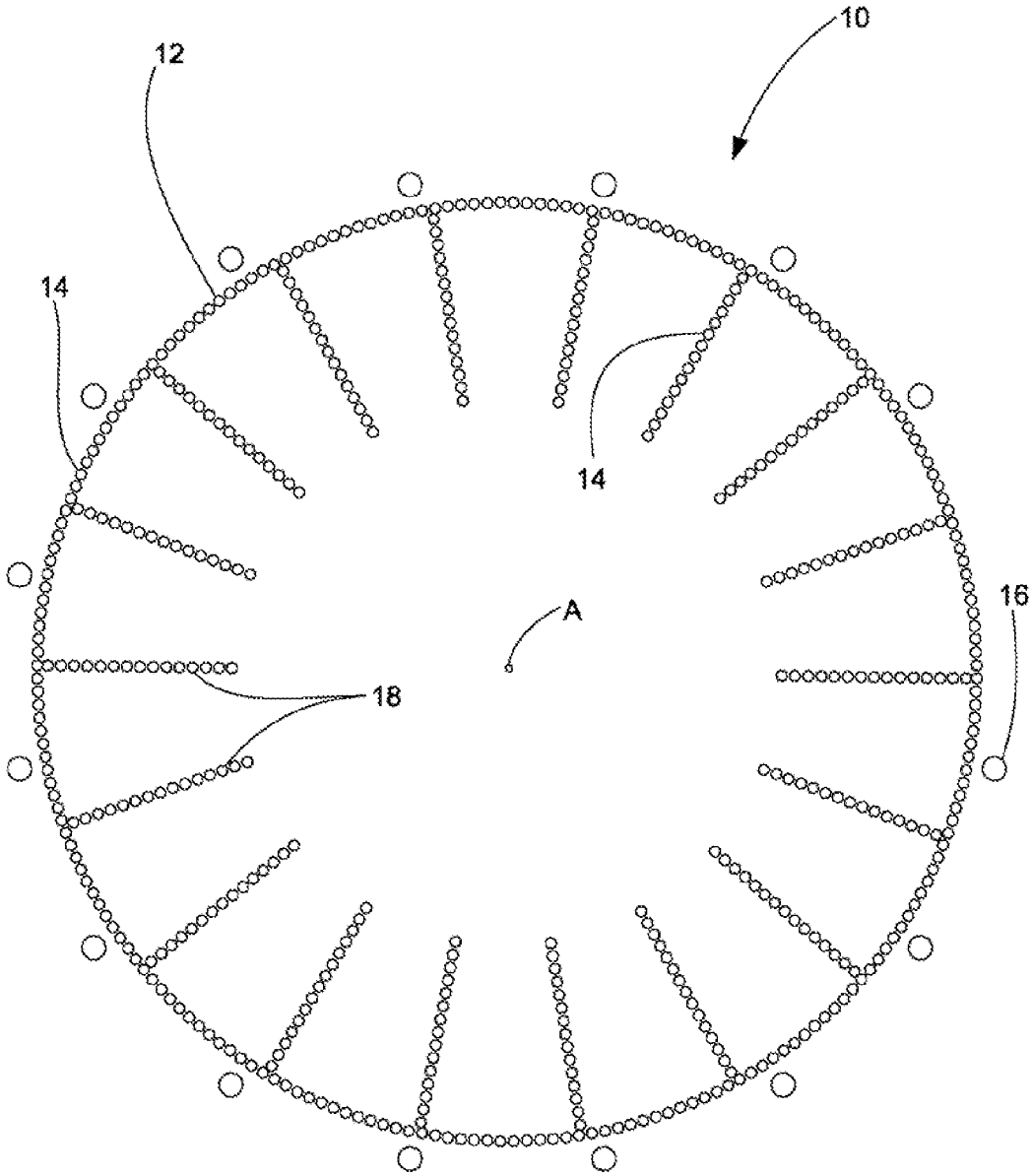
FIG. 2 is a sectional view of FIG. 1 viewed in the direction of arrows 2-2 of FIG. 1.

Referring to the drawings generally, wherein like reference numerals designate the same or functionally similar elements throughout the several drawings, and to FIG. 1 in particular, there is shown a perspective view, partly in section, of a cage-like tubular structure to which the principles of the present invention may be applied. FIG. 2 is a sectional view of FIG. 1 taken in a plane perpendicular to the longitudinal axis of FIG. 1.

Briefly, the cage-like tubular structure, generally designated 10, is predominantly a cylindrical structure which, when erected, has its longitudinal axis A oriented vertically. The structure 10 has a substantially cylindrical enclosure wall 12 which is comprised of tubes 14. In addition, the structure 10 may also be provided with other tubular structures 16 which lie outboard of the enclosure wall 12.

The cage-like tubular structure may also comprise internal tubular structures or platens 18, each of which may be generally constructed as a planar, "dog leg" or other shape bank of tubes 14 provided adjacent to one another, and which may be provided with inlet and outlet manifolds or headers 20. The number and arrangement of the platens 18 can vary depending upon the service requirements of the cage-like tubular structure 10; they can be arranged radially as shown; they can be fewer or greater in number, and they are not necessarily identical to one another (although symmetrical arrangements are likely to predominate). The tubes 14 forming the enclosure wall 12 and platens 18 may be, for example, 2" OD tubes of relatively thin wall thickness and narrow spacing. The tubes 14 forming the enclosure wall 12 may be membraned wall construction as described above. The tubes 14 forming the platens 18 may incorporate loose tube construction, membrane wall construction, or tangent tube construction with a full weld between the tubes to form a tangent tube panel. Loose tube constructions, or for portions of the platens where no membrane is provided, may be provided with split ring castings as is known to those skilled in the boiler arts to preserve tube alignment under various operating conditions. There may be a small gap between the tube enclosure wall 12 and the platens 18, or there may be a weld along a portion, portions, or along the entire length of an edge tube 14 of some or all of the platens 18 to a tube of the enclosure wall 12.

The cage-like tubular structure 10 may be provided with inlet 22 (not shown in FIG. 1) and outlet 24 structures which may be frustoconical or tapered as shown at 24, and to which the aforementioned manifolds or headers 20, as well as the other tubular structures 16, may be attached. While the term substantially cylindrical is used to refer to the fact that the cage-like tubular structure 10 has an enclosure wall 12 which is cylindrical for a majority of its length, save for the inlet and outlet structures 22, 24, it will be appreciated that the term substantially is also employed since the enclosure wall 12 is actually comprised of a plurality of planar sections as will be described later.

Figure 3:
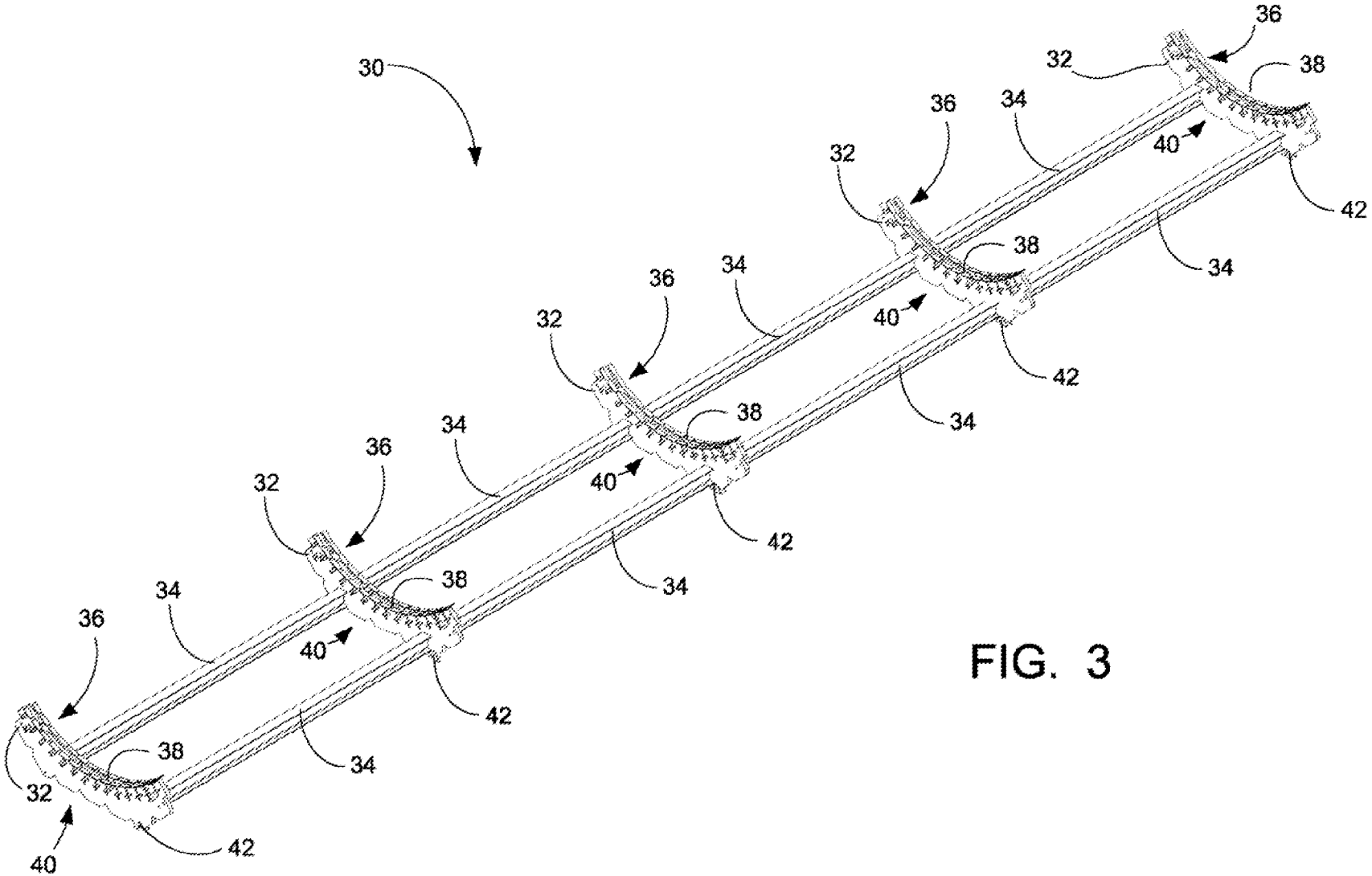
FIG. 3 is a perspective view of a first embodiment of an exo-skeleton apparatus subassembly according to the present invention.

Referring now to FIG. 3, there is illustrated an embodiment of an exo-skeleton apparatus subassembly, generally designated 30, according to the present invention. In its most basic form, the subassembly 30 comprises a plurality of saddles or arch supports 32 spaced from one another along a length of the subassembly 30. The arch supports 32 are interconnected and fixed relative to one another by longitudinal members 34, advantageously structural I-beams or the like. The combination of the arch supports 32 and the interconnecting longitudinal members 34 provide a relatively stiff structural base upon which the cage-like, tubular structure 10 will be assembled, one segment at a time. The number of arch supports 32 may be selected to provide sufficient spaced support for the tubes 14 so that excessive bowing or sagging of the tubes 14 is avoided.

Each of the arch supports 32 has a curved, upper portion 36 which will support the tubes 14 making up the enclosure wall 12 of the tubular structure 10. The curvature of the upper portion 36 closely matches the curvature of the enclosure wall 14. The upper portion 36 of each arch support 32 is also provided with plurality of pushers 38 which are used to adjust the positions of tubes 14 which are laid thereupon during assembly of the tubular structure 10. Each of the arch supports 32 also has a lower or base portion 40 which will rest upon the ground or floor during construction of an individual segment of the cage-like, tubular structure 10, or on the surface of a transportation device such as a flatbed rail car, truck bed, barge or ship. Each of the arch supports 32 may also be provided with a pivot means 42 at one or both ends which permits the exo-skeleton subassembly 30 to be rolled to better position the subassembly 30 as required to facilitate manufacture of the segment of the cage-like, tubular structure 10.

The number of subassemblies 30 is a matter of choice; in the embodiments shown, four (4) such subassemblies 30 are used to create four (4) individual segments of the cage-like, tubular structure 10, and in this embodiment each of the exo-skeleton subassemblies spans approximately 90 degrees of the circumference of the enclosure wall 12. Fewer or greater numbers of subassemblies 30 may be employed, however, it is envisioned that at least two (2) such subassemblies 30 would be employed due to the large size of the cage-like, tubular structures 10 which must be assembled and eventually transported to its final destination in the field. For example, if three (3) subassemblies 30 are employed, each would span 120 degrees of the circumference of the enclosure wall 12. Five (5) such subassemblies 30 results in each such subassembly 30 spanning 72 degrees, and so on. It will thus be seen that by breaking the tubular structure 10 into smaller, more manageable parts or segments, their assembly, manipulation and transportation is facilitated since their size, weight and height is a fraction of that possessed by the final tubular structure 10.

Figure 4:
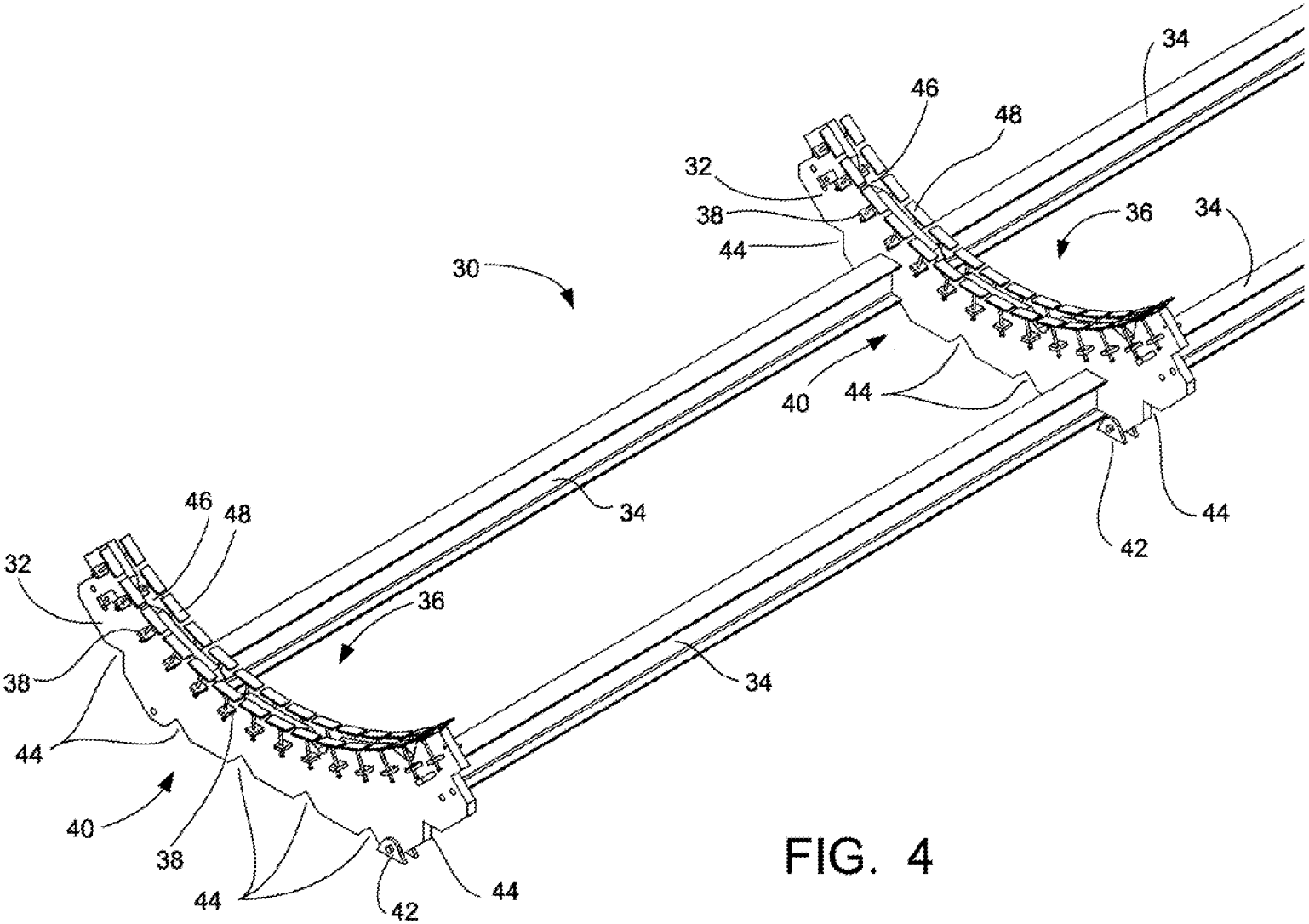
FIG. 4 is a is a close-up view of the lower left-hand portion of FIG. 3.

Referring now to FIG. 4, which is a close-up view of the lower left-hand portion of FIG. 3, additional details of the construction of the individual arch supports 32 may be seen. Each arch support 32 is provided with cut-outs or notches 44 on the lower portion 40 which engage adjustable jacks or supports 60 (not shown in FIG. 4) to hold the subassembly 30 in position when it is rolled about the pivot means 42. Cut-outs or notches 46 are also provided on the curved upper portion 36 of each arch support 32, but their purpose is to accept the tubular structures 16 which lie outboard of the enclosure wall 12 of the tubular structure 10. Each of the pushers 38 is advantageously provided with a bearing plate 48 which will support the tubes 14 laid thereupon. As indicated earlier, the term substantially cylindrical when applied to the cage-like, tubular structure 10 is also employed to clarify that the tubular structure 10 may actually be comprised of a plurality of planar sections. In other words, the enclosure wall 12 is actually a polygon made up of a plurality of "n-packs" 50 of tubes 14 (not shown in FIG. 4 but shown in FIG. 5); where n is typically 4, but where it can be a larger or smaller number. The larger the number of tubes 14 in a planar section, the fewer the number of planar sections which will have to be welded to one another as they rest upon the bearing plates 48 of the arch supports; however, this increases the degree to which the outer circumference of the enclosure wall 12 departs from a true cylindrical configuration. Thus, in order to increase manufacturing efficiency and reduce manufacturing costs, the enclosure wall 12 will typically be made of 4-packs of tubes assembled and welded together to form the enclosure wall 12.

The bearing plate 48 will thus have a length sufficient to span the number of tubes 14 forming an "n-pack" 50 of tubes 14. The width of the bearing plate 48 will likely be selected to ensure that the bearing load on an individual bearing plate 48 will not cause deformation or kinking of the tubes 14 as they rest upon the bearing plate 48.

Figure 5:
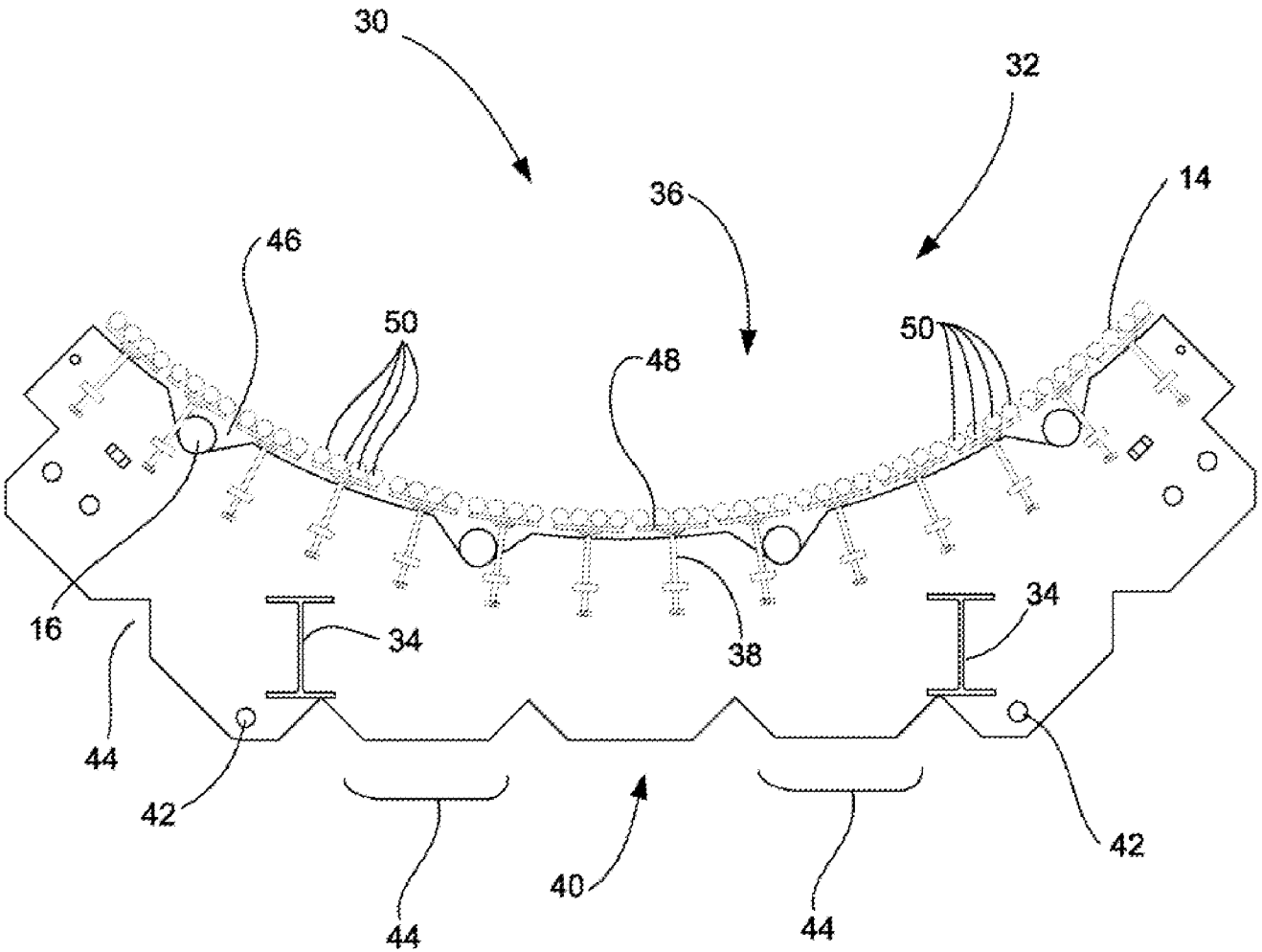
FIG. 5 is an end view of an individual arch support according to the present invention.

FIG. 5 is an end view of an individual arch support 32 according to the present invention, illustrating an array of n-packs 50 of tubes 14 which have been positioned upon the subassembly 30. Since this arch support is one of four (4) individual exo-skeleton subassemblies 30, the curved upper portion 36 spans 90 degrees of the enclosure wall 12. The individual pushers 38 may comprise simple threaded bolt and nut assemblies or other more complex devices which can be extended towards or away from the tubes 14 to provide for alignment of the tubes 14 in one n-pack 50 with the tubes 14 in an adjacent n-pack 50. Multiple pushers 38 may be provided for individual n-packs 50 if required. This is especially important when these separate n-packs 50 are to be connected together by the welding of membrane in between the tubes 14 of one n-pack 50 and the tubes 14 of an adjacent n-pack 50.

Figure 6:
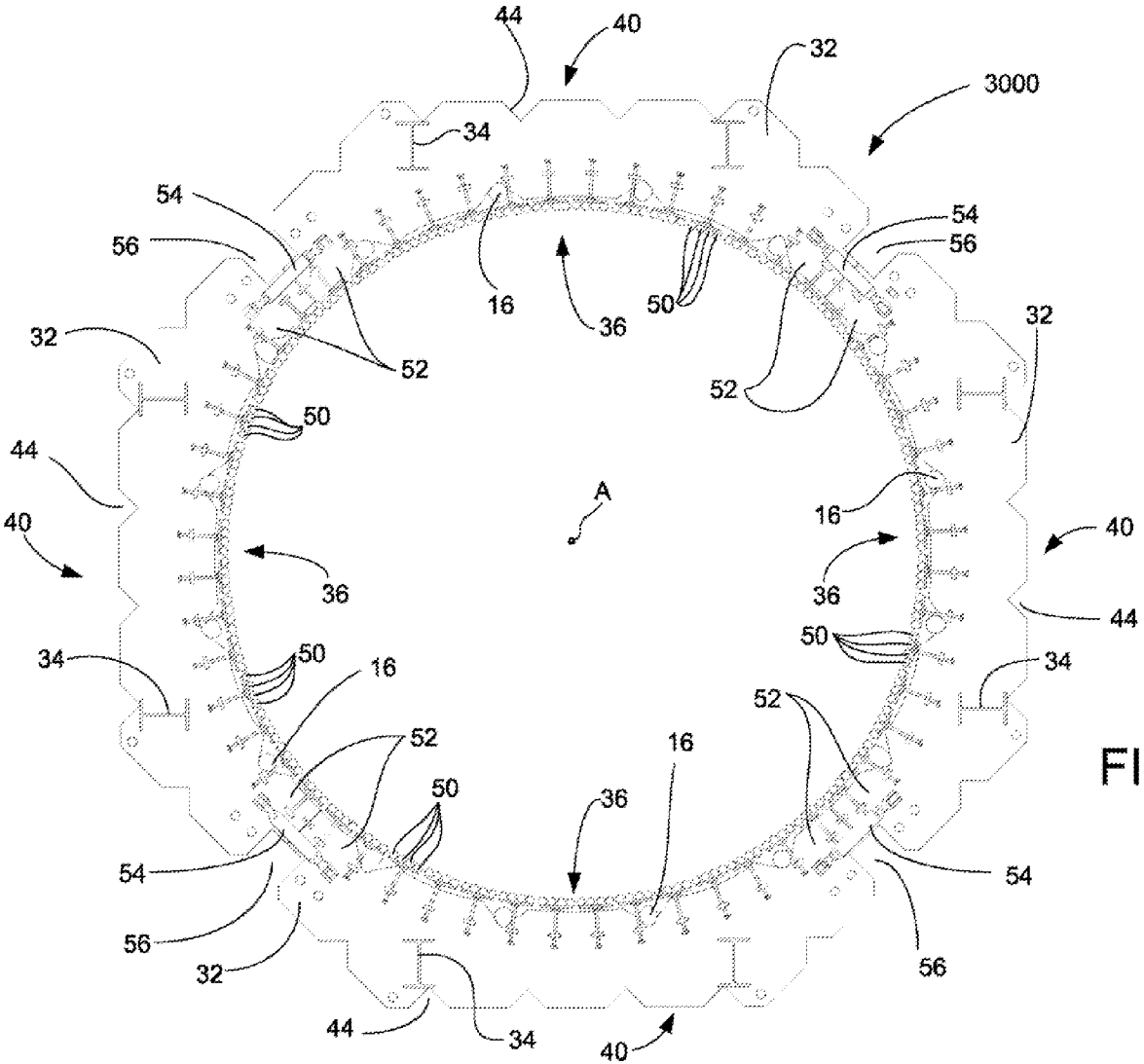
FIG. 6 is an end view of an assembled exo-skeleton comprised of four (4) exo-skeleton subassemblies and their associated segments of the cage-like, tubular structure, according to the present invention.
Figure 8:
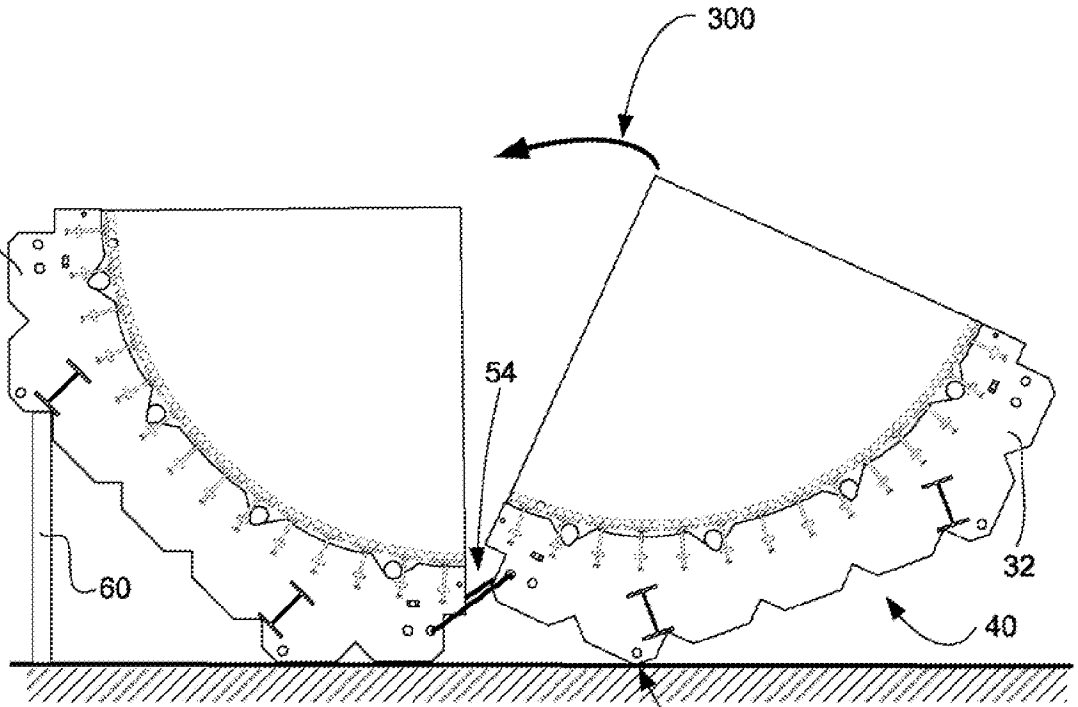
FIGS. 7, 8 and 9 are schematic representations of how one exo-skeleton subassembly is rolled into position adjacent to another exo-skeleton sub assembly to form a "half" subassembly) and then how the two halves are then rolled together to create a complete exo-skeleton according to the present invention.
Figure 7:
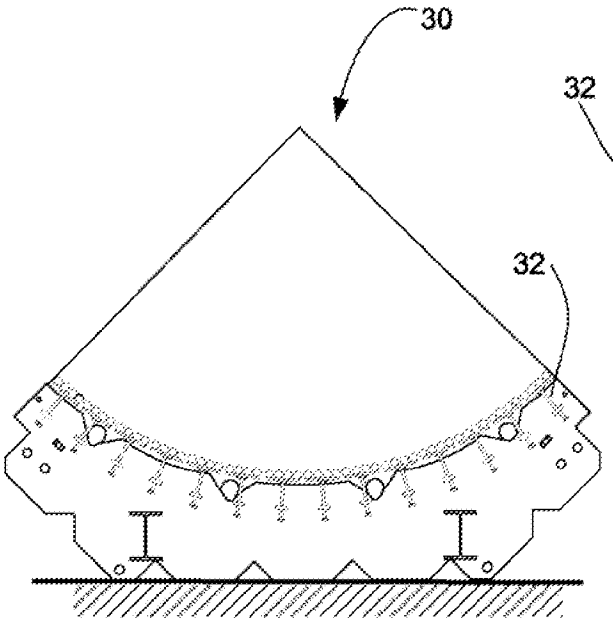
Figure 9:
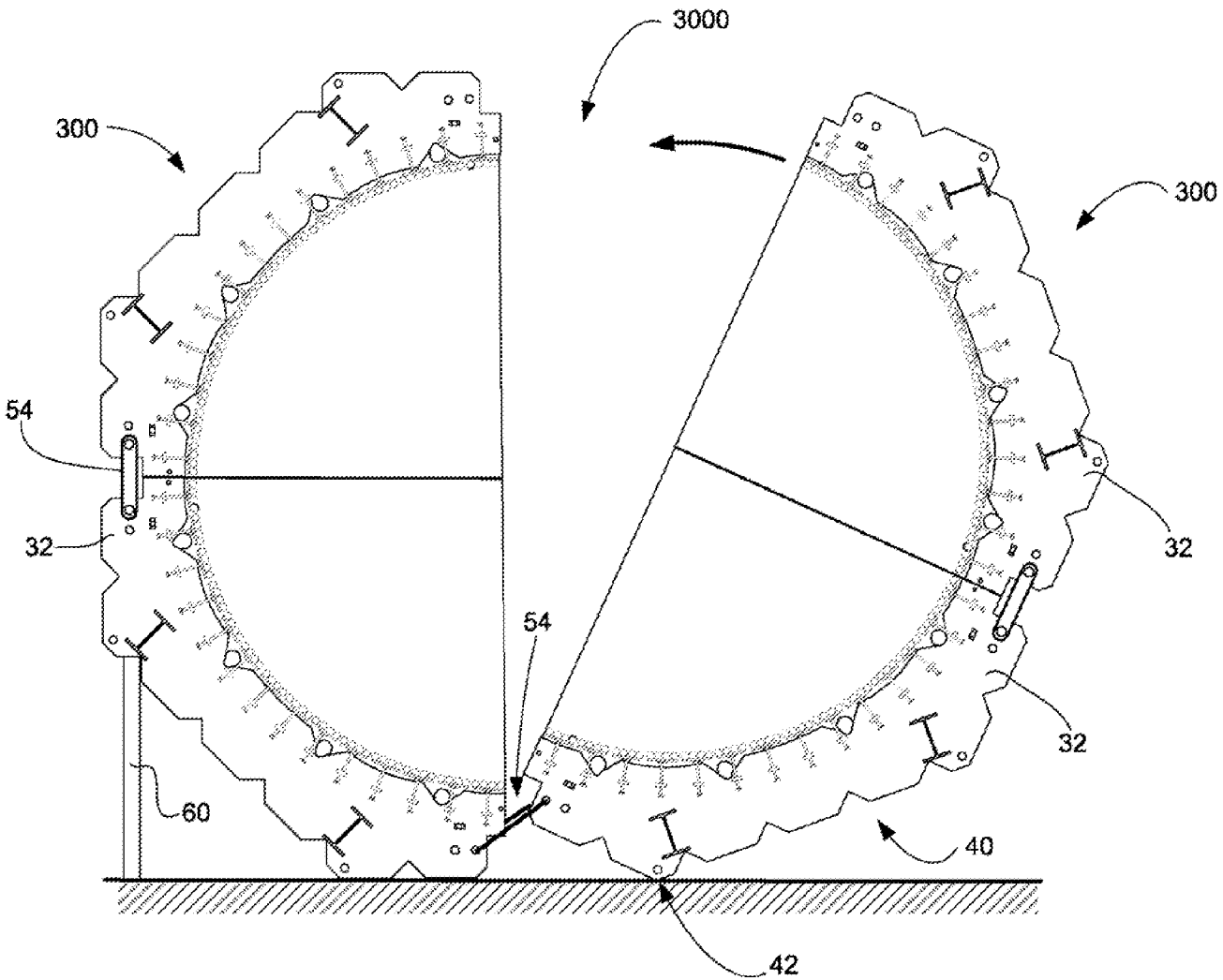

FIG. 6 is an end view of an assembled exo-skeleton, generally designated 3000, comprised of four (4) exo-skeleton subassemblies 30 and their associated segments of the cage-like, tubular structure 10 which together make up the tubular structure 10. Each of the arch supports 30 has ends 52, each one of which is connected to an adjacent end 52 of another arch support 30 by means of an adjustable turnbuckle type or other type of device 54. Device 54 may comprise come alongs, or hydraulic, pneumatic, electrical, cable or chain types of devices and the term turnbuckle will be used for the sake of simplicity to refer to such devices and their equivalents. The turnbuckles 54 are used to control the final increments of the positioning of one exo-skeleton subassembly 30 as it is rolled into position adjacent another exo-skeleton sub assembly 30 and those two subassemblies 30 are drawn together to form a "half" subassembly 300. Additional plating or bracing spanning the joint between separate arch supports 32 may be applied to further stiffen and strengthen the half subassembly 300. The procedure is repeated for another "half" subassembly 300, and then the two halves are then rolled together to create the complete exo-skeleton 3000. A schematic representation of this assembly process is illustrated in FIGS. 7, 8 and 9. FIG. 7 illustrates a ¼ cage assembly, completed. FIG. 8 illustrates two ¼ cages assembled on a floor or transport device. FIG. 9 illustrates two ½ cages assembled on a floor or transport device.

Figure 10:
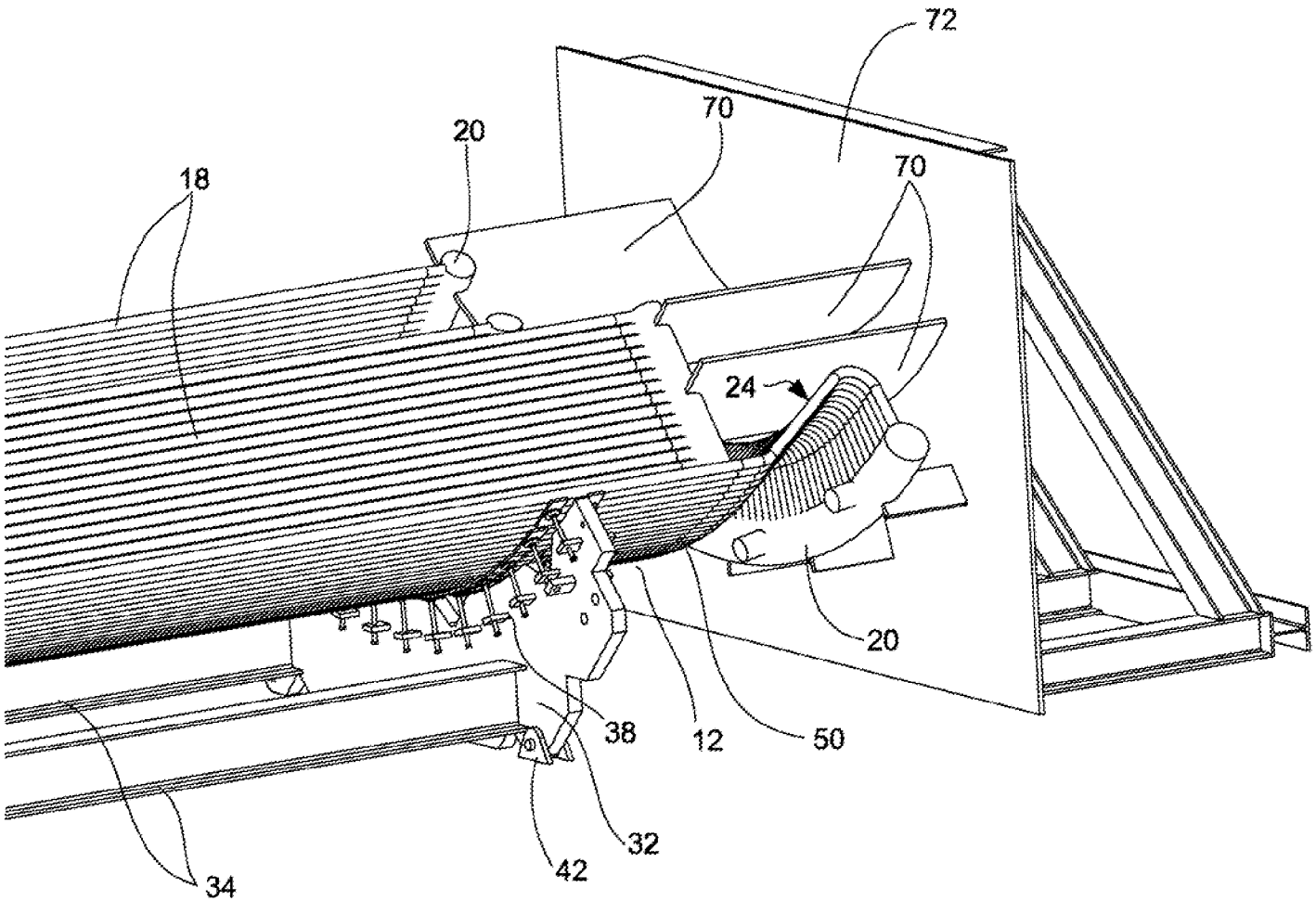
FIG. 10 is a perspective view, partly in section, of one end of an exo-skeleton subassembly illustrating the assembly of a segment of the cage-like, tube assembly according to the present invention.

FIG. 10 is a perspective view, partly in section, of one end of an exo-skeleton subassembly 30 illustrating the assembly of a segment of the cage-like, tube assembly 10 according to the present invention. A lower end of the cage-like, tubular structure 10 is illustrated. Once the various n-packs 50 of tubes have been positioned on the subassembly 30 and welded together, the placement and assembly of the platens 18 is begun. The platens 18 are lowered into the subassembly 30 using a crane and the headers 20 are fit into pre-positioned saddles or saddle-like structures 70 attached to a header fixture 72. A similar procedure is used at the opposite end of the tubular structure 10.

Figure 11:
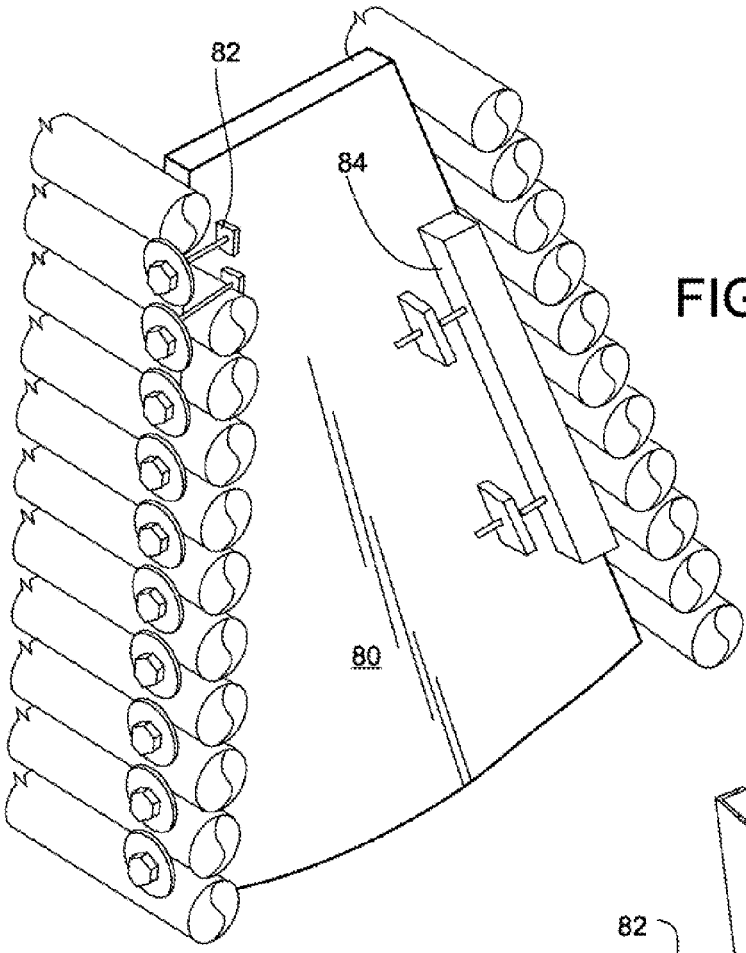
FIGS. 11 and 12 illustrate keystone bracing which is provided between individual platens to support and locate the platens within the cage-like, tubular structure according to the present invention.
Figure 12:
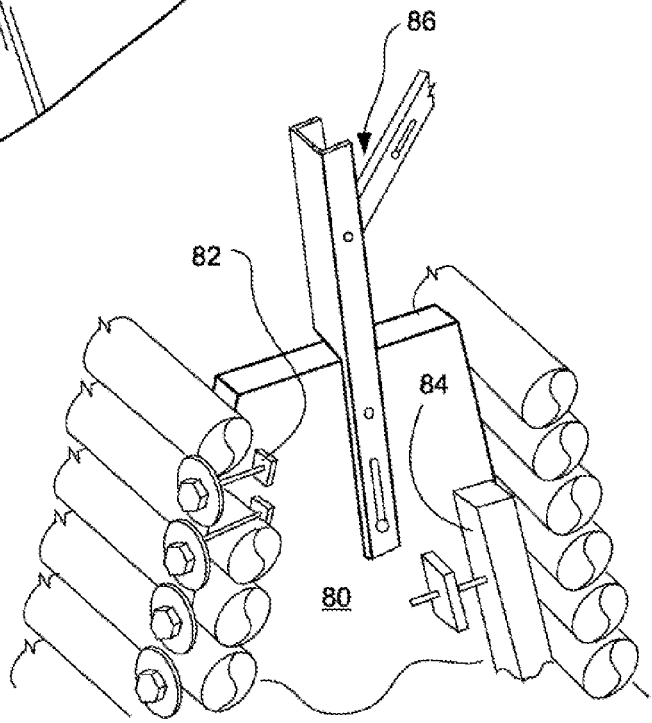

Next, keystone bracing 80, as illustrated in FIGS. 11 and 12, is provided between individual platens 18 at (or near) each of the arch supports 32 which serve to support and locate the platens 18 within the cage-like, tubular structure 10. One or more removable attachment means 82 are provided on one or both edges of an individual keystone brace 80 to attach the brace 80 to one or both adjacent platens 18, while adjustable pusher means 84 are provided on one or both edges to engage the adjacent platens 18. To keep the braces 80 against the enclosure wall 12, a removable, folding structure 86 is provided and attached to each keystone brace 80. The folding structure may advantageously be comprised of rectangular tubing with slots, adjustable all thread, hex nut pushers or other means (such as hydraulic, pneumatic, or electrical). Once the exo-skeleton subassemblies 30 have been assembled to a sufficient degree to provide at least 180 degrees of cage-like, tubular structure 10, and up to the point of completion of the complete exo-skeleton 3000, the folding structure 86 is provided and adjusted to outwardly force diametrically opposed keystone braces 80 against the enclosure wall 12 to fix them and their associated platens 18 in place until the folding structure 86 can be removed after final assembly and vertical erection of the cage-like, tubular structure 10 has been completed in the field.

Figure 13:
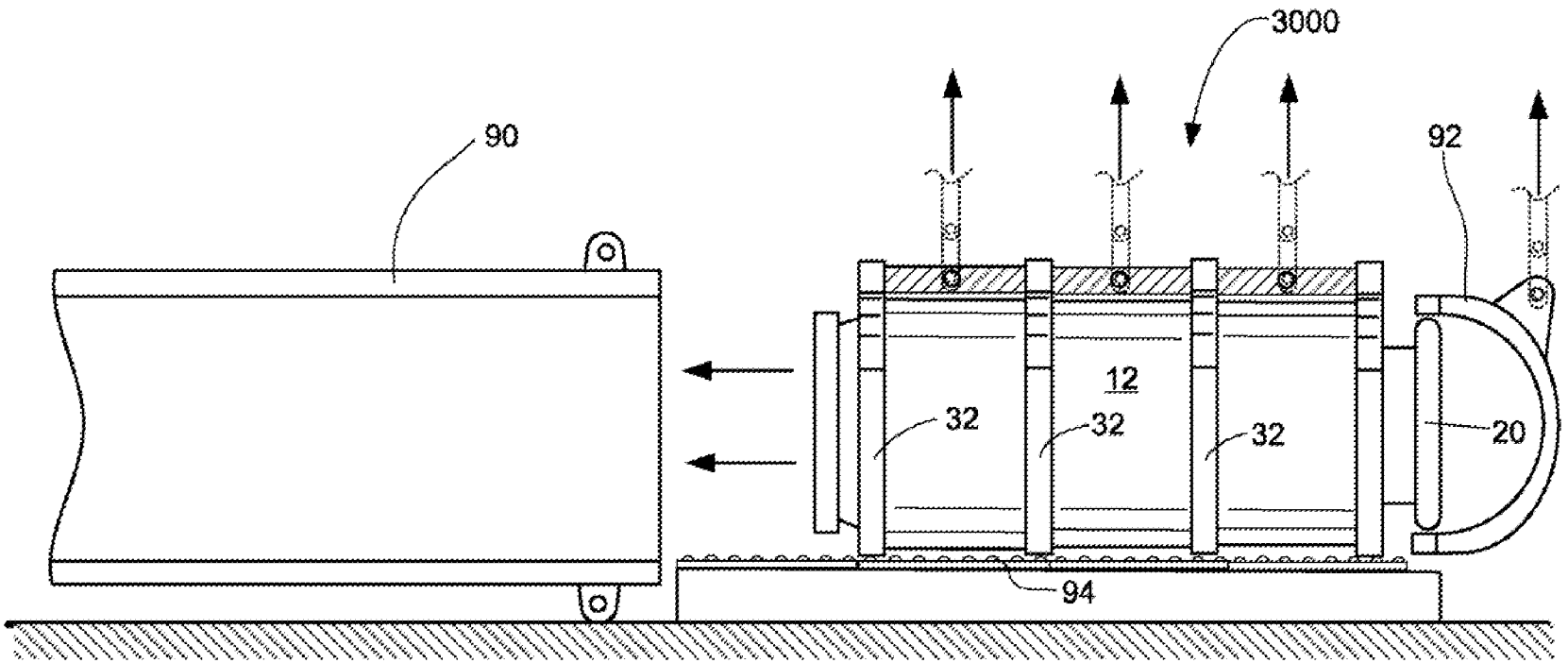
FIGS. 13 and 13A illustrate the horizontal insertion of the cage-like, tubular structure into a vessel using the exo-skeleton according to the present invention.
Figure 13A:
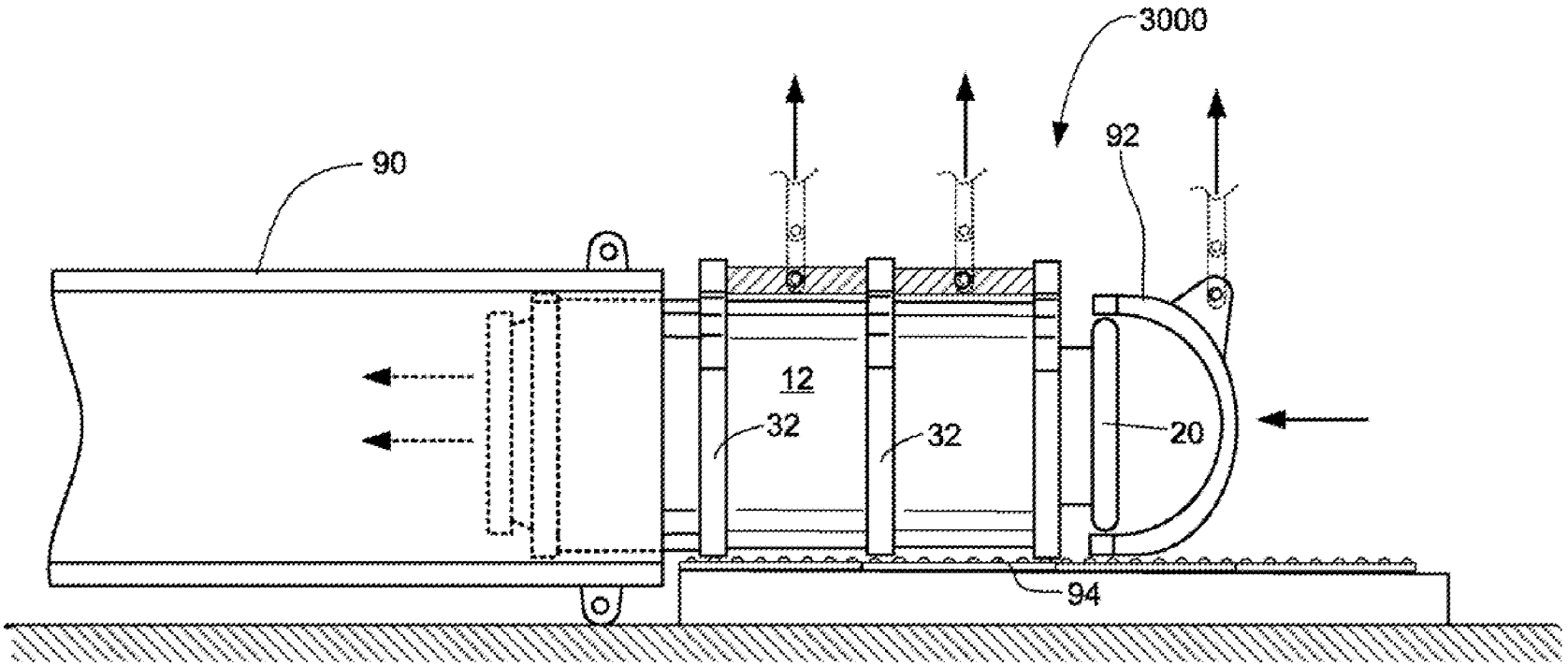
Figure 14:
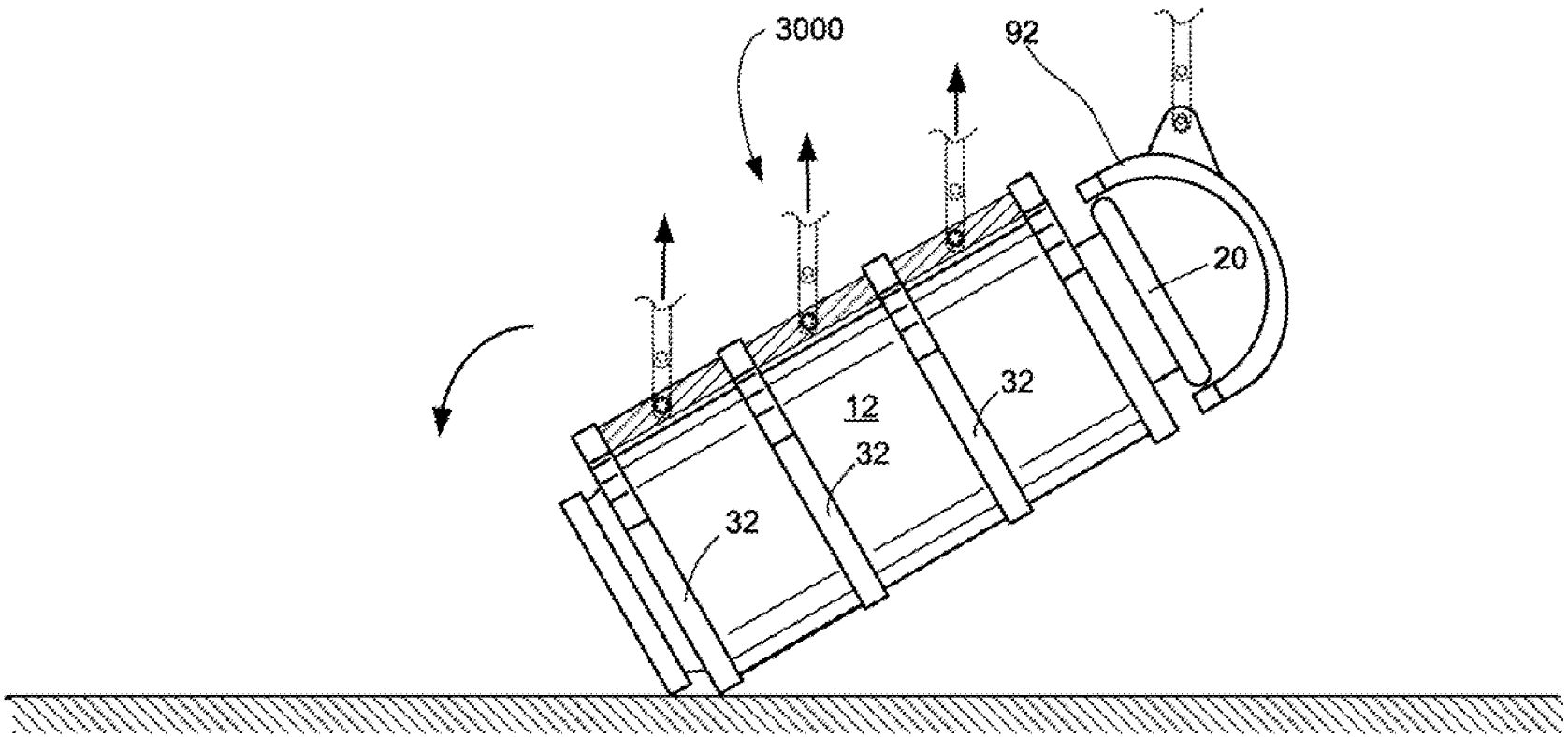
FIG. 14 illustrates the use of the exo-skeleton according to the present invention to upend the entire cage-like, tubular structure contained therein to permit the structure to be lowered into a vessel.

FIGS. 13, 13A and 14 illustrate two alternate methods by which the complete cage-like, tubular structure 10 contained within the exo-skeleton 3000 may be inserted into a vessel 90. In FIGS. 13 and 13A, the tubular structure 10, to which a vessel head 92 has been attached, is rolled horizontally into the vessel 90. The upper three arch supports 32 are removed prior to jacking up the cage-like, tubular structure 10 and lower arch support 32 and then lowering the arch support assembly 32 to allow for clearance of the vessel head 92 past the arch support 32. As the tubular structure 10 is inserted into the vessel 90, the cage-like, tubular structure 10 becomes supported by the vessel shell inside diameter. Rolls 94 and associated track or rails are employed for this purpose. The rolls may be provided on the cage-like, tubular structure 10 and the rails below, or vice versa; rolls and rails also would be provided for the vessel head 92 to separately support it as it is inserted into the vessel. FIG. 14 illustrates how the exo-skeleton 3000 may be employed to upend the entire cage-like, tubular structure 10 contained therein to permit the structure 10 to be lowered into the vessel 90 (not shown in FIG. 14).

Figure 15:
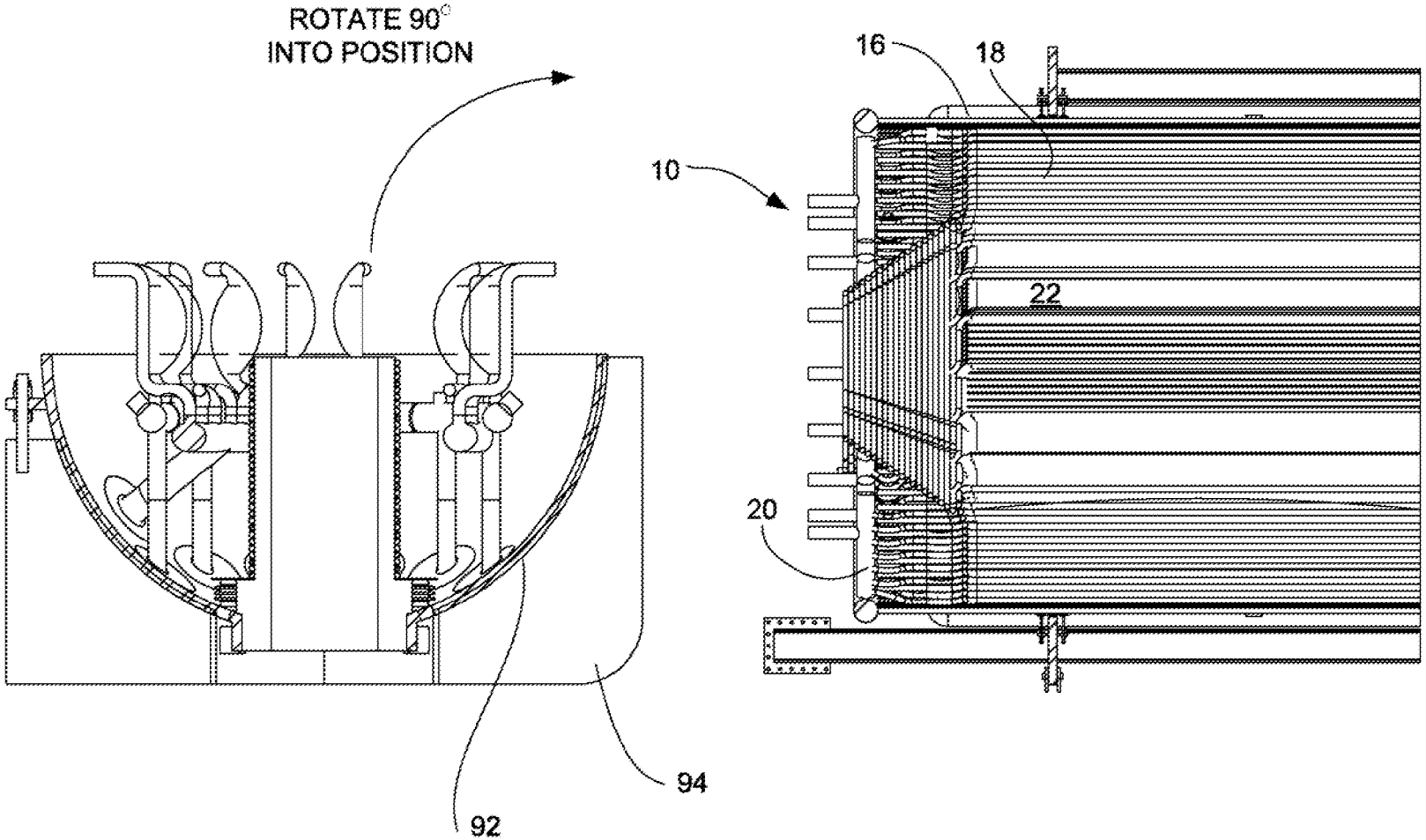
FIG. 15 illustrates an apparatus and method for positioning a vessel head adjacent the end of the cage-like, tubular structure once the latter has been completely assembled within the exo-skeleton according to the present invention.

FIG. 15 illustrates an apparatus and method for positioning the vessel head 92 adjacent the end of the cage-like, tubular structure 10 once the latter has been completely assembled within the exo-skeleton 3000. An upending fixture 94 having a curved portion is removably attached to the vessel head 92. The dimensions of the fixture 94 are selected to match up and position the vessel head 92 in alignment with the mating portions of the headers 20 and other portions of the cage-like, tubular structure 10, once the fixture 94 has been lifted and rotated counterclockwise about the curved portion as shown. Pushers, come-alongs or other devices can then be used to bring the vessel head 92 into mating position with the tubular structure 10.

Figure 16:
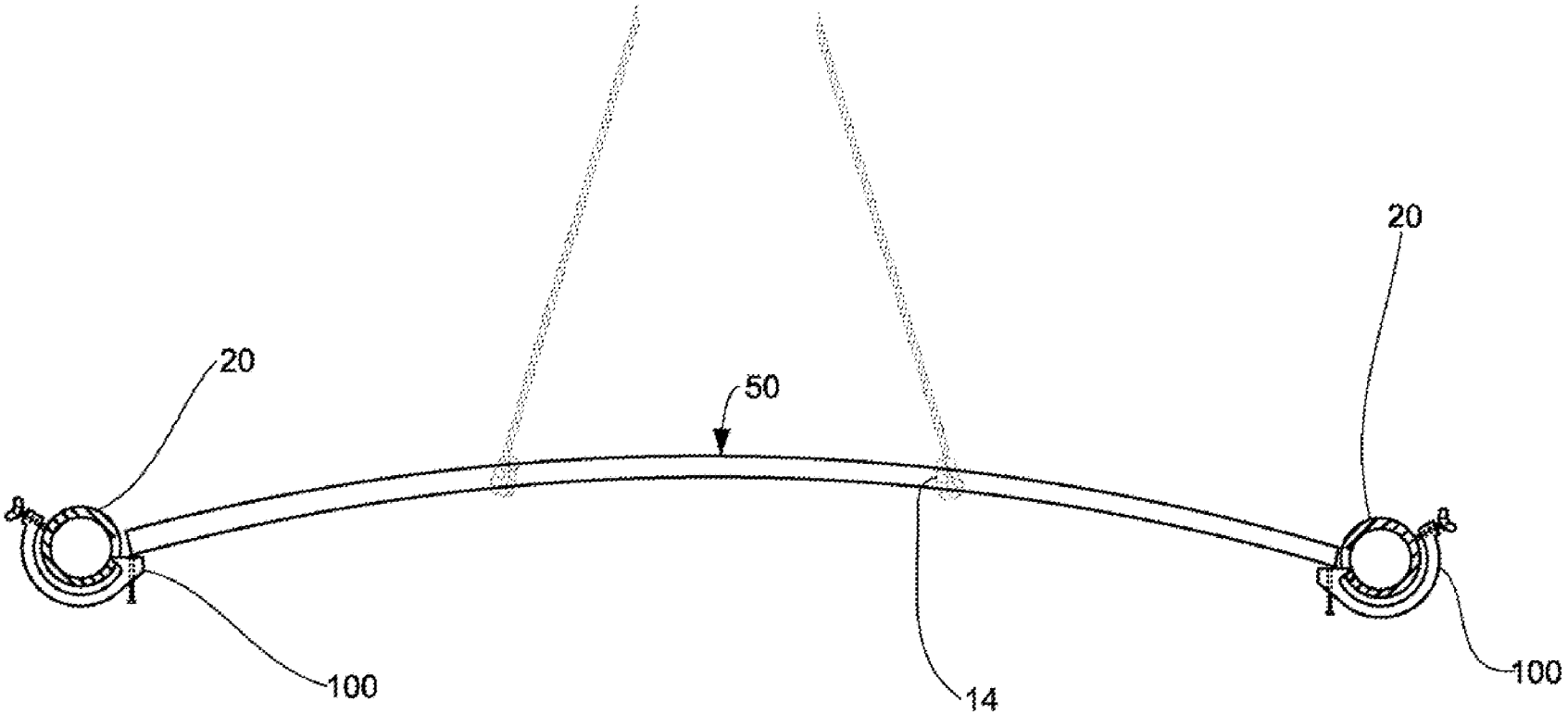
FIG. 16 illustrates how a typical, elongated panel of tubes behaves when lifted for placement on an exo-skeleton subassembly according to the present invention.
Figure 17:
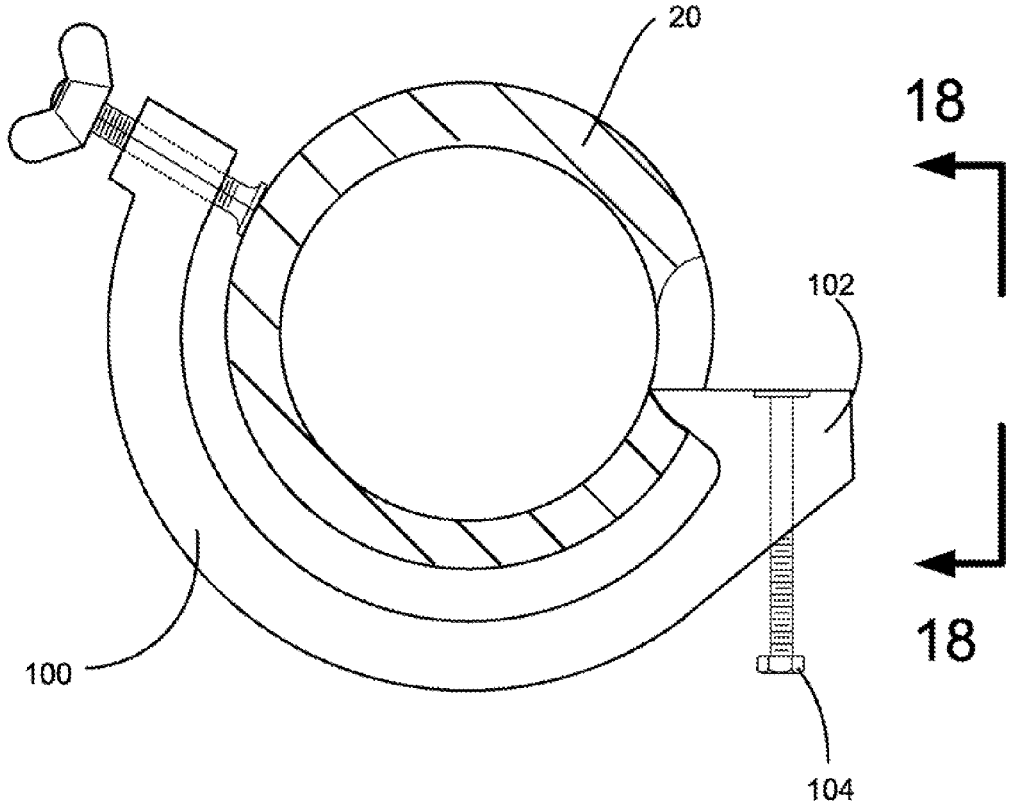
FIGS. 17 and 18 illustrates a panel/header tube end guide tool according to the present invention, FIG. 18 being a view of FIG. 17 taken in the direction of arrows 18-18.
Figure 18:
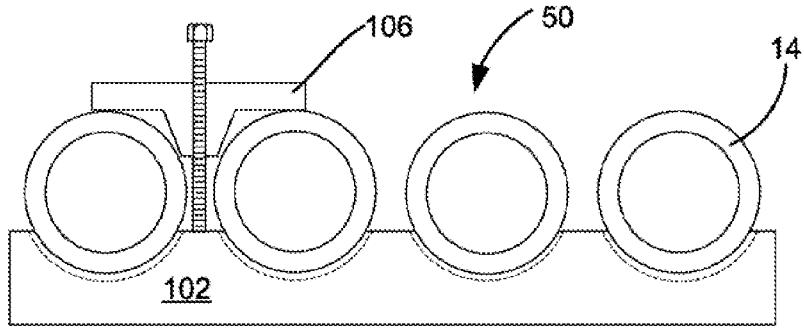

FIG. 16 illustrates how a typical, elongated n-pack 50 of tubes 14 would behave when lifted for placement onto an exo-skeleton subassembly 30 (not shown in FIG. 16 for clarity). The same curvature of the n-pack panel 50 which facilitates insertion of the ends of the tubes 14 into the headers 20 at each end of the subassembly 30 (due to shortening of the n-pack 50 overall length) may also create the need for a panel/header tube end guide tool 100 as illustrated in FIGS. 17 and 18. The tool 100 is a C-clamp type device that has a claw action to retain its location when installed on the header 20. There are four bosses in an end 102 of the tool 100 which fit the tube pattern in the header 20. The other end of the C has a fastener that pushes into the OD of the header 20 in the opposite direction creating a lock of the tool 100 onto the header 20. The ends of the tubes 14 will come to rest in the grooves in the tool 100. As the n-pack panel 50 is lowered, the arch in the panel 50 begins to subside and the ends of the tubes 14 move outwardly towards and into the header 20 weld preps. Pushers 104 may be provided to keep the tubes 14 from gouging into the tool 100 too sharply as well as to push them down if they do not lay flat in the grooves. A wedging device 106 may also be provided to spread the tubes 14, if required. A coating of nylon or other low friction material may be provided to allow slippage of the tubes 14 while clamped.

Figure 19:
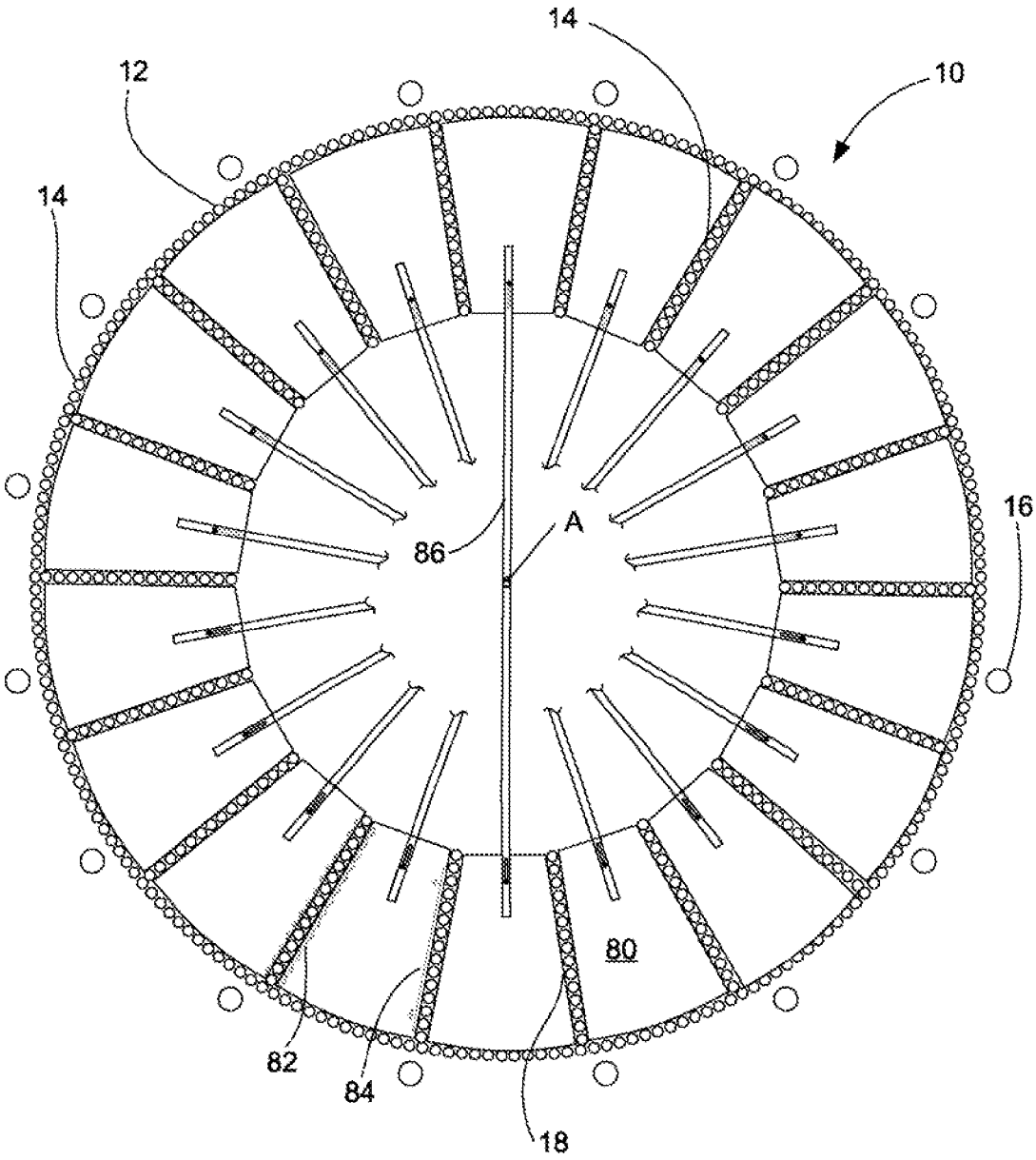
FIG. 19 illustrates the keystone bracing as provided between individual platens to support and locate the platens within the cage-like, tubular structure according to the present invention.

FIG. 19 illustrates how the keystone bracing 80 of FIGS. 11 and 12 is provided to support and locate the platens 18 within the cage-like, tubular structure 10. The folding structure 86 extends diametrically across the cage-like, tubular structure 10, engaging opposed pairs of keystone bracing 80. The pairs of keystone braces 80 may be spaced axially along the longitudinal axis A so as to not interfere with one another.

While specific embodiments of the invention have been shown and described in detail to illustrate the application of the principles of the invention, those skilled in the art will appreciate that changes may be made in the form of the invention covered by the following claims without departing from such principles. For example, while the method and apparatus of the present invention has been described in the context of a cage-like structure for a synthesis gas cooler, it will be appreciated that the principles of the present invention may be applied to the manufacture, assembly and/or transportation of other cage-like structures having substantially cylindrical walls but which are not rigid, easily handled structures which can be easily manipulated. The present invention is particularly suited to the manufacture and assembly of cage-like, substantially cylindrical structures made of long, slender tubular components which, by themselves, are not self-supporting. Similarly, in some circumstances it may be desirable to install all the n-packs 50 for a given subassembly 30, but not weld them to one another until after all tube 14 to header 20 welds have been seal welded, in order to seal, position, and manage distortion and shrinkage. Thus, in some embodiments of the invention, certain features of the invention may sometimes be used to advantage without a corresponding use of the other features, and certain features may be employed in a different order. Accordingly, all such changes and embodiments properly fall within the scope of the following claims.

We claim:

1. A method for manufacturing a substantially cylindrical, cage-like, tubular structure, comprising:

providing at least two exo-skeleton subassemblies each including a plurality of arch supports interconnected and fixed relative to one another by longitudinal members to provide a relatively stiff structural base upon which the substantially cylindrical, cage-like, tubular structure is assembled;

placing a plurality of n-packs of tubes on a first one of the exo-skeleton subassemblies and longitudinally welding the n-packs of tubes to each other to form a first portion of an enclosure wall of the tubular structure;

placing a plurality of n-packs of tubes on a second one of the exo-skeleton subassemblies and longitudinally welding the n-packs of tubes to each other to form a second portion of an enclosure wall of the tubular structure;

rotating one of the exo-skeleton subassemblies towards the other exo-skeleton subassembly causing one of the plurality of n-packs of tubes to be rotated towards the other plurality of n-packs of tubes so that ends of the first and second portions of the enclosure wall are adjacent to one another and securing the exo-skeleton subassemblies together to form an exo-skeleton assembly; and welding the adjacent ends of the first and second wall enclosure portions to one another to form the substantially cylindrical, cage-like, tubular structure within the exoskeleton.

2. The method according to claim 1, comprising providing headers positioned by a header fixture adjacent longitudinal ends of the exo-skeleton subassemblies and lowering the plurality of n-packs of tubes onto the exo-skeleton subassemblies so that ends of the tubes in the n-packs of tubes are inserted into the headers.

3. The method according to claim 2, comprising providing a panel/header tube end guide tool on the headers to guide the ends of the tubes into the headers.

4. The method according to claim 1, comprising providing platens positioned above either the first or second portions of the enclosure wall and providing keystone bracing to support and locate the platens within the substantially cylindrical, cage-like, tubular structure.

5. The method according to claim 4, comprising forcing diametrically opposed keystone bracing against the enclosure wall to fix them and their associated platens in place within the tubular structure and the exo-skeleton assembly.

6. The method according to claim 1, comprising providing pusher means for aligning the plurality of n-packs of tubes with one another to permit welding together of same.

* * * * *